United States Patent [19]

Raker

[11] Patent Number: 5,025,814

[45] Date of Patent: Jun. 25, 1991

[54] CIGARETTE FILTERS CONTAINING STRANDS OF TOBACCO-CONTAINING MATERIALS

[75] Inventor: Mark L. Raker, Clemmons, N.C.

[73] Assignee: R. J. Reynolds Tobacco Company, Winston-Salem, N.C.

[21] Appl. No.: 49,200

[22] Filed: May 12, 1987

[51] Int. Cl.[5] ..... A24D 1/04; A24D 3/06

[52] U.S. Cl. ..... 131/331

[58] Field of Search ..... 131/331, 365, 343, 353, 131/374, 353; 162/139

[56] References Cited

U.S. PATENT DOCUMENTS

| | | | |
|---|---|---|---|
| 2,001,709 | 5/1935 | Davidson . | |
| 2,039,298 | 5/1936 | Davidson . | |
| 2,164,702 | 7/1939 | Davidson . | |
| 2,168,474 | 8/1939 | Davidson . | |
| 2,202,839 | 6/1940 | Davidson . | |
| 2,801,636 | 8/1957 | Pfoh | 162/139 |
| 2,849,932 | 9/1958 | Marogg . | |
| 2,852,987 | 9/1958 | Schanz . | |
| 2,900,989 | 8/1959 | Davidson . | |
| 2,948,282 | 8/1960 | White . | |
| 3,084,697 | 4/1963 | Eissmann . | |
| 3,203,432 | 8/1965 | Green et al. | 131/325 |
| 3,219,041 | 11/1965 | Bromberg . | |
| 3,230,958 | 1/1966 | Dearsley . | |
| 3,299,895 | 1/1967 | Dearsley . | |
| 3,368,566 | 2/1968 | Avedikian . | |
| 3,589,373 | 6/1971 | Hooper . | |
| 3,713,451 | 1/1973 | Bromberg . | |
| 3,858,587 | 1/1975 | Cavelli et al. . | |
| 3,910,166 | 10/1975 | Sexstone . | |
| 4,126,141 | 11/1978 | Grossman . | |
| 4,140,135 | 2/1979 | Godfrey, Jr. . | |
| 4,168,712 | 9/1979 | Labbe . | |
| 4,176,668 | 12/1979 | Fiore et al. . | |
| 4,291,711 | 9/1981 | Berger . | |
| 4,357,950 | 11/1982 | Berger . | |
| 4,396,026 | 8/1983 | Grossman . | |
| 4,619,948 | 10/1986 | Kennedy et al. . | |
| 4,889,143 | 12/1989 | Pryor et al. . | |

FOREIGN PATENT DOCUMENTS

| | | |
|---|---|---|
| 431817 | 8/1970 | Australia . |
| 333620 | 12/1918 | United Kingdom . |

*Primary Examiner*—V. Millin

[57] ABSTRACT

Filter rods for cigarette manufacture include a plurality of strands of a reconstituted tobacco material. The tobacco material includes a sizing agent having a hydrophobic character. A rod having a circumference of about 24 mm can have about 320 strands of a sheet-like material cut at about 32 cuts per inch. The strands extend along the longitude of the rod. The filter elements provided from the rods provide a useful mouthpiece for cigarettes and also impart a unique tobacco taste.

34 Claims, 7 Drawing Sheets

CIGARETTE FILTERS CONTAINING STRANDS OF TOBACCO-CONTAINING MATERIALS

BACKGROUND OF THE INVENTION

This invention relates to smoking articles such as cigarettes, and in particular to filters for smoking articles having longitudinally extending strands provided from tobacco-containing sheet-like materials.

Popular smoking articles such as cigarettes have a substantially cylindrical rod shaped structure which includes a charge of smokable material such as tobacco surrounded by a wrapper such as paper. It has become desirable to manufacture cigarettes having filters constructed from fibrous materials such as cellulose acetate. Such filters can provide unique taste characteristics to cigarettes as well as preventing tobacco particles from being drawn into the smoker's mouth during use of the cigarette.

Conventional methods for making cigarette filters involve the forming of rods from a source of cellulose acetate filter tow. Exemplary methods and apparatus are disclosed in U.S. Pat. Nos. 3,741,846; 4,132,189 and 4,283,998 to Greve et al.

Filter and mouthpiece elements for cigarettes containing tobacco materials have been proposed in U.S. Pat. Nos. 2,190,107 to Pohle; 2,792,006 to Marek; 2,804,874 to Visnick; 2,948,282 to White; 3,046,994 to Schur; 3,101,723 to Seligman et al; 3,219,041 to Bromberg; 3,428,050 to Kandel; 3,368,566 to Avedikian; 3,858,587 to Cavelli; 3,353,543 to Sproull et al; 3,361,139 to Inove; 3,713,451 to Bromberg; and 4,291,711 to Berger.

Filter elements containing creped paper are proposed in U.S. Pat. Nos. 3,251,365 to Keith et al; 3,900,037 to Horsewell et al; 3,320,960 to Molins; 2,669,995 to Troy; and 3,875,949 to Harendza-Harinxma et al.

Filter elements having spirally wound materials are proposed in U.S. Pat. Nos. 2,992,648 to Weiss; and 2,785,681 to Fessler. A filter element proposed in U.S. Pat. No. 4,488,563 to Morifugi et al includes fiber tow having a corrugated sheet wound therearound such that the grooves of the corrugated sheet extend in the longitudinal direction of the filter element. A cigarette filter element containing absorbent paper which is wound or folded substantially parallel to the longitudinal axis of the cigarette is proposed in U.S. Pat. No. 3,933,160 to Gerady.

In U.S. Pat. No. 3,395,713 to Ent-Keller a filter element having corrugated or spirally shaped longitudinally extending paper membrane is proposed. A plurality of metal containing heat absorbing ribbons extend through a cigarette filter cartridge as proposed in U.S. Pat. No. 3,304,944 to Badertscher.

U.S. Pat. Nos. 2,001,709; 2,164,702 and 2,202,839 to Davidson propose cigarette mouthpieces manufactured from folded or laminated paper. Davidson also proposes cigarette mouthpieces made from a plurality of longitudinally extending strands of paper in U.S. Pat. Nos. 2,039,298 and 2,168,474. Other types of filters from paper-like materials are proposed by Maroog in U.S. Pat. No. 2,849,932 and by Schanz in U.S. Pat. No. 2,852,987. Cigarette rods provided from strands of smokable materials are proposed in U.S. Pat. Nos. 3,084,697 to Eissmann; 3,230,958 and 3,299,895 to Dearsley and 3,589,373 to Hooper.

Many of the previously disclosed filter elements have not achieved any substantial commercial acceptance.

The apparent absence of filter elements (other than those manufactured from cellulose acetate) from the marketplace may be due to a variety of factors. For example, cigarettes having such filter elements may be difficult or expensive to manufacture, or exhibit a poor or off taste.

It would be highly desirable to provide a smoking article such as a cigarette exhibiting the desirable characteristics of a filter cigarette while providing the user with a unique tobacco taste. In particular, it would be desirable to efficiently and effectively produce a unique filter element.

SUMMARY OF THE INVENTION

This invention relates to a rod suitable for the preparation of cigarette filter elements. The rod includes a plurality of strands provided from tobacco-containing sheet-like material. The strands extend generally along the longitude of the rod, each have a width greater than the thickness thereof, and are contained in a circumscribing wrap. The sheet-like material includes a hydrophobic sizing agent. The sizing agent can be incorporated into the sheet-like material during the manufacture thereof, and is employed in an amount such that the aerosol which passes through the filter element during use of the cigarette does not exhibit an overly great dry or harsh taste.

In yet another aspect, this invention relates to a substantially cylindrical cigarette filter element or plug having a filter medium and a circumscribing wrap covering the longitudinally extending surface of the filter medium such that the ends of the filter element are open to permit the passage of air and smoke therethrough. The filter medium includes a plurality of strands provided from tobacco-containing sheet-like material. The strands extend generally along the longitude of the filter element. The sheet-like material includes a hydrophobic sizing agent.

In still another aspect, this invention relates to a cigarette comprising a substantially cylindrical rod of smokable material axially aligned with and attached to one end of the aforementioned filter element.

The rods of this invention can be manufactured using an apparatus having:

(a) means for providing a web of reconstituted tobacco material;

(b) means for slitting the web into a plurality of longitudinally extending strands, the slitting means having (i) two cutter assemblies each having a series of circular cutter knives aligned on a central shaft at spaced apart intervals in an essentially parallel manner along the shaft;

(ii) the cutter knives of one shaft extend between the spaces between the cutter knives of the other shaft, and the shafts are rotated in opposite directions so that the web is fed into the nip of the two cutter assemblies and cut into strands by the action of the overlapping knives;

(iii) the two cutter assemblies aligned essentially parallel to one another in the vertical plane and at an angle to one another in the horizontal plane such that the point of contact of the overlapping knives is above the plane formed by the shafts;

(iv) the cutter knives each having an individual width less than that of the individual spaces between the knives such that one cutter knife of one cutter assembly contacts only one knife of the other cutter assembly;

(c) means for receiving and forming the strands into a rod-like shape thereby forming a rod-like composite wherein the strands are aligned in an essentially longitudinally extending manner;

(d) means for circumscribing the rod-like composite with wrapping material thereby forming a continuous rod; and (e) means for subdividing the continuous rod into a plurality of rods.

The apparatus allows for the efficient and effective preparation of consistent quality rods for use in the manufacture of cigarettes. For example, sheet-like, tobacco-containing material can be employed in providing the aforementioned strands, and the subsequently provided rods can be employed in the manufacture of cigarette filter elements. Of particular interest is the fact that tobacco-containing filter elements, when employed as filter elements for filter cigarettes, are capable of providing the user of such a cigarette with a unique tobacco taste. Also of interest is the fact that the structure of the tobacco-containing filter elements of this invention are such that the resulting filter elements exhibit good firmness and integrity. Thus, the discomfort associated with tobacco particles being drawn into the cigarette user's mouth is minimized or eliminated under conditions of normal use. As a consequence, the tobacco-containing filter elements provide a suitable mouthpiece for cigarettes.

DETAILED DESCRIPTION OF THE EMBODIMENTS

Figure 1:
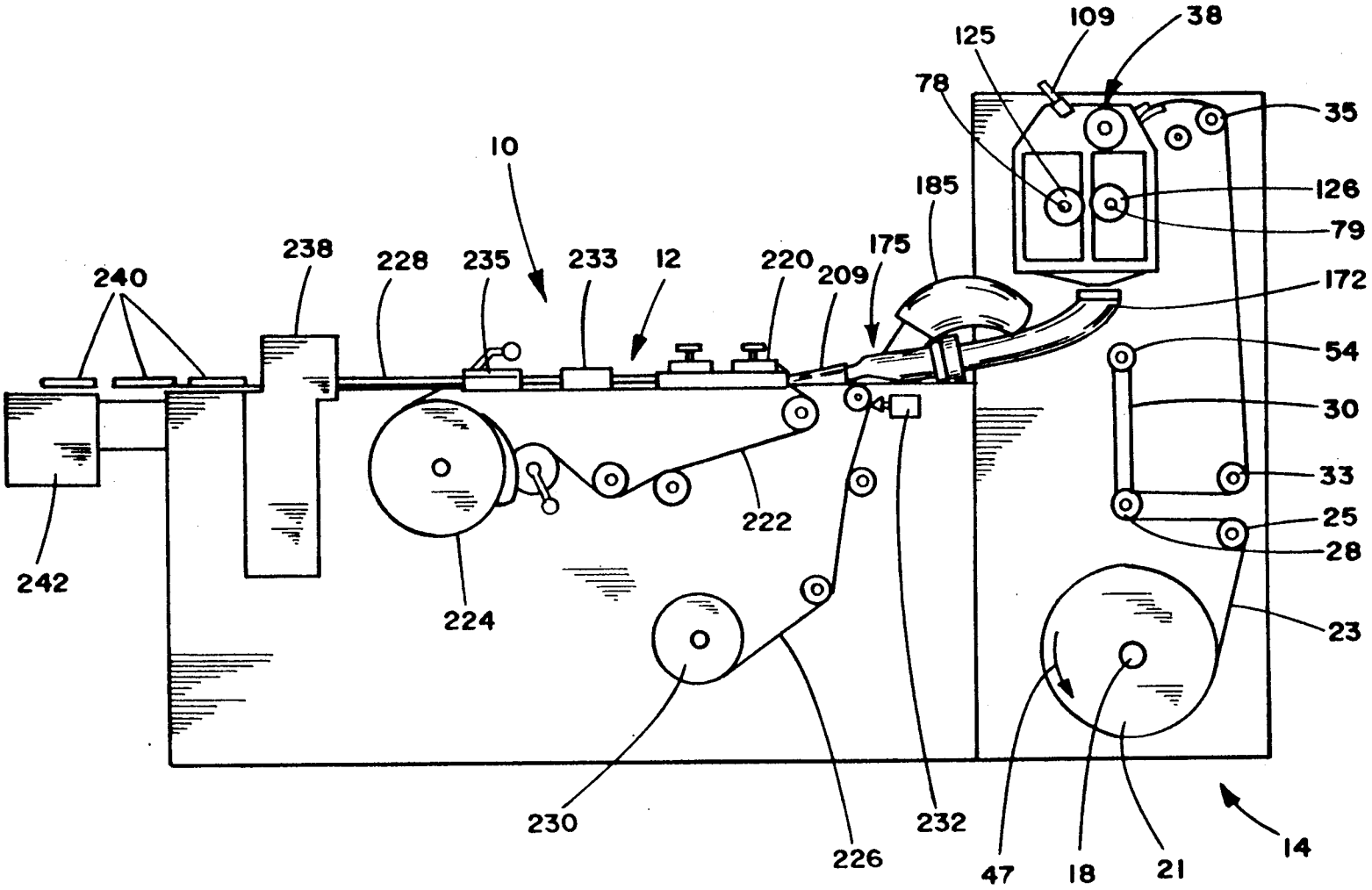
FIG. 1 is a diagrammatic illustration of a rod-making apparatus including the source of sheet-like material, the web control means for providing sheet at a controlled tension, the slitting means for forming strands of the cut or shredded material, and the rod-forming unit.

Referring to FIG. 1, rod making apparatus 10 includes a rod making unit 12 and a strand forming unit 14. The rod making unit 12 can vary and is preferably a conventional apparatus for making cigarette filter rods. An exemplary rod making unit 12 is a commercially available Hauni KDF 2 from Hauni-Werke Korber & Co. Kg., Hamburg, Fed. Rep. of West Germany. The manner of operation of a suitable rod making unit is known by the skilled artisan.

The strand forming unit 14 includes a rotatable mandrel 18 for supporting a bobbin 21 of sheet-like material 23. The mandrel includes a chuck or other such means for gripping the internal hollow core of the bobbin. An exemplary chuck is described in U.S. Pat. No. 3,792,868. The web 23 is fed from the bobbin 21 around a fixed guide roller 25 and around a dancer roller 28. The dancer roller is carried by a movable arm 30 thereby forming a dancer unit, such that a web 23 can be fed from the bobbin 21 and obtained at a relatively constant, controlled tension. The web passes from the dancer roller 28 around fixed guide roller 33, around yet another fixed guide roller 35, and into slitting unit 38. The combination of the mandrel 18, dancer roller 28 and guide rollers 25, 33 and 35 provide a web control means for providing web at a controlled tension. Other configurations of mandrel, dancer roller and guide rollers may be apparent to the skilled artisan.

Figure 2:
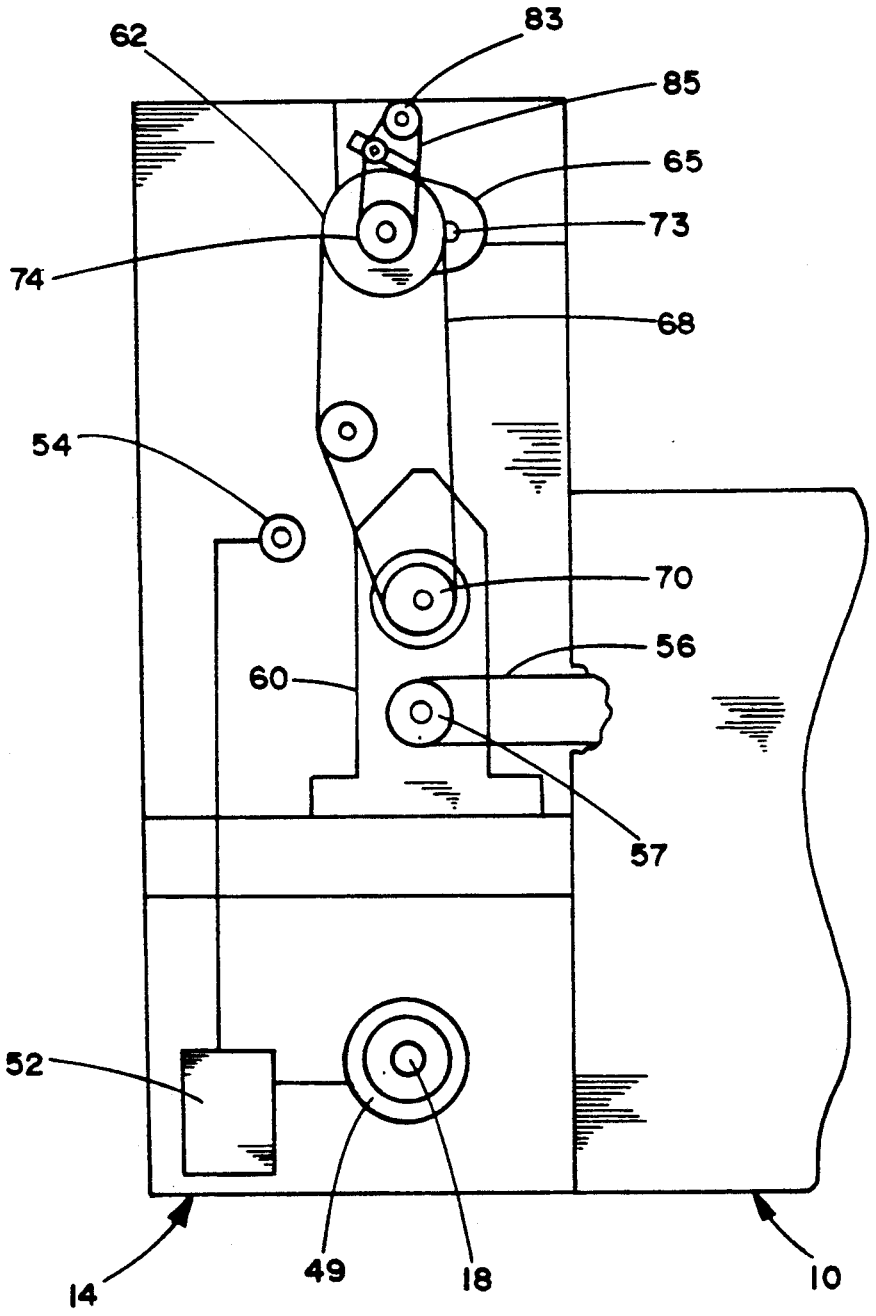
FIG. 2 is a diagrammatic illustration of a portion of the apparatus shown in FIG. 1, and in particular a rear view showing the rear portion of the web control means and various drive means for operation of the apparatus.

Referring to FIGS. 1 and 2, mandrel 18 allows the bobbin 21 to be rotated such as in the direction shown by arrow 47 (see FIG. 1) thereby providing for feed of web 23. The rate of rotation of the mandrel is controlled by braking system 49. A braking system suitable for controlling the rate of rotation of the mandrel will be apparent to the skilled artisan. The braking system 49 is in turn controlled by tension control unit 52 (e.g., a pneumatic tension control unit or other type of transducer). The transducer 52 receives a signal from a potentiometer 54 or other such device which provides a response to the movement of pivoting arm 30 of the dancer unit. The rate at which the web is fed from the bobbin is controlled depending upon the amount of tension which the web experiences. Thus, the tension which the web experiences can be maintained at a preset amount by a setting of the transducer.

Figure 3:
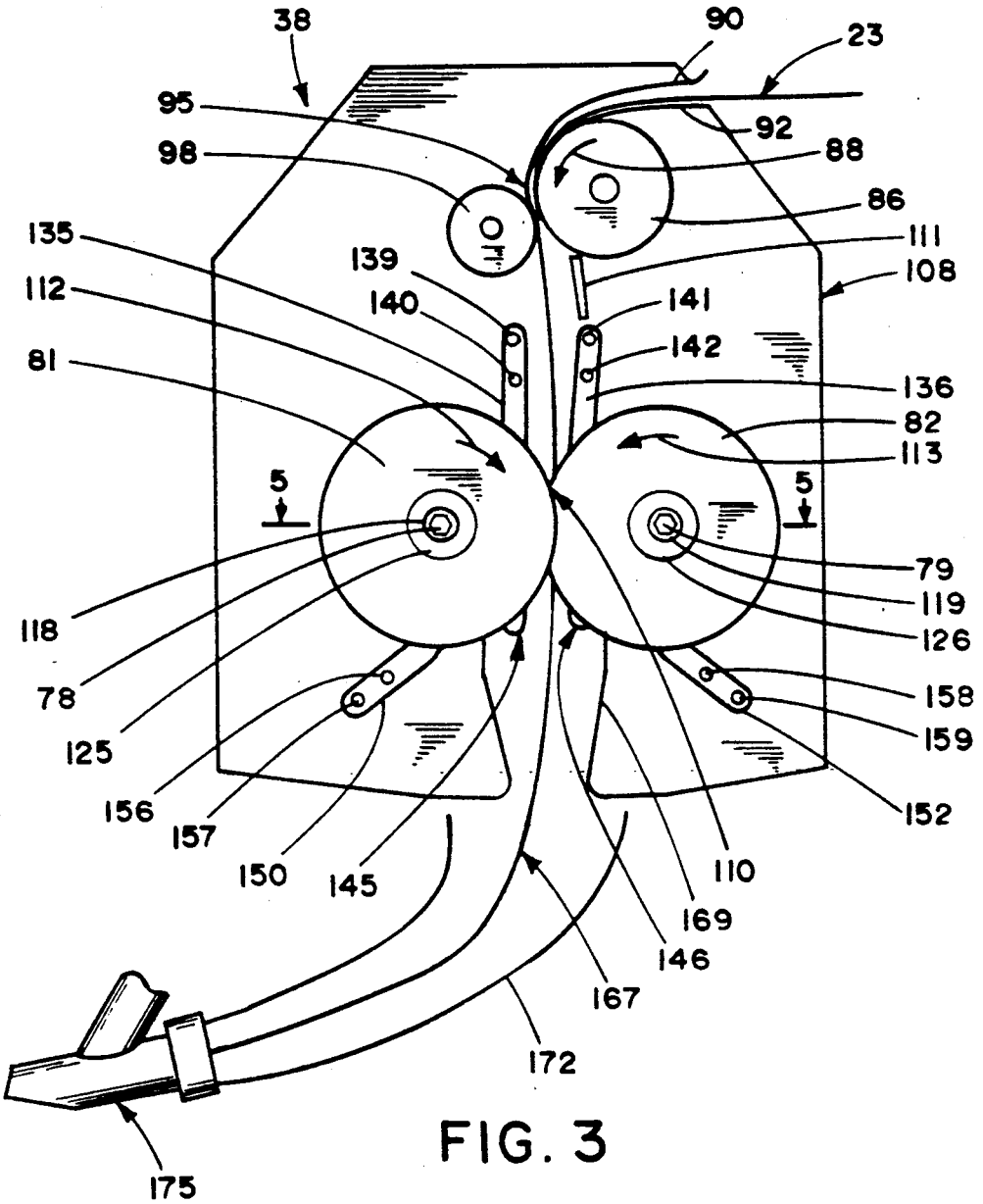
FIG. 3 is an enlarged partial sectional view of the slitting means, condensing funnel and stuffer jet shown in FIG. 1.

Referring to FIGS. 1, 2 and 3, the rate at which the web passes through slitting unit 38 is controlled by the rod making unit 12 using drive belt 56 or other appropriate means for contacting the drive shaft 57 of variable speed drive unit 60. The variable speed drive unit 60 is controlled in order that the slitting unit 38 is operated at the appropriate speed. In particular, the variable speed drive unit 60 controls the rotation of pulley 62 or other suitable drive unit of transmission unit 65 by drive belt 68 which is positioned between drive unit 62 of the transmission unit 65 and a drive unit such as pulley 70 of the variable speed drive unit 60. The transmission unit 65 includes a gear assembly (not shown) which provides for rotation of pulleys 73 and 74 which in turn provide for rotation of central shafts 78 and 79, respectively, which in turn provide a manner for rotating the respective series of cutter knives 81 and 82 of the slitter unit 38. A suitable gear assembly will be apparent to the skilled artisan. The pulley 74 is connected to pulley 83 by drive belt 85, or the like. Drive unit 83 turns drive roller 86 in the direction shown by arrow 88 in FIG. 3. Drive roller 86 is rotated in the same direction as central shaft 79.

Figure 4:
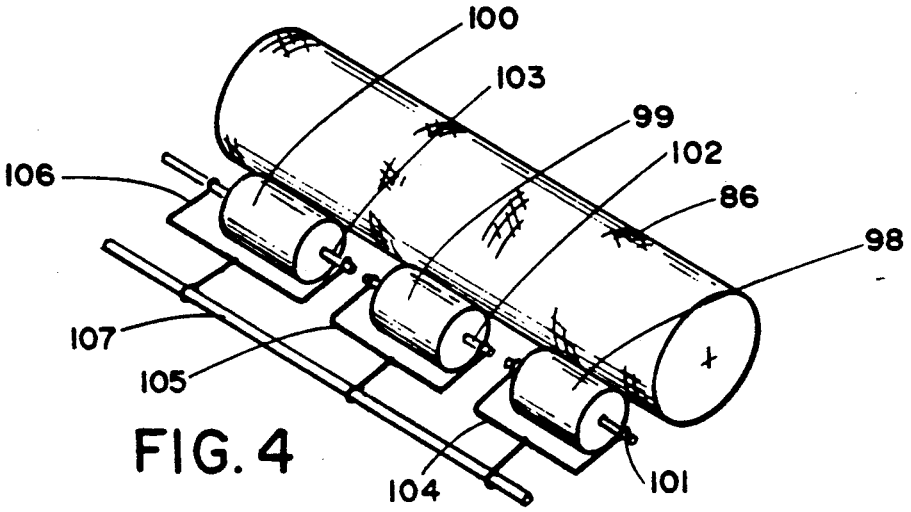
FIG. 4 is an enlarged perspective of the drive roller means of the slitting means.

Referring to FIGS. 3 and 4, web 23 is fed into the slitter unit 38 through a feed means having an upper web guide plate 90 and a lower web guide plate 92. The feed means can be stainless steel sheet or the like, and provides for the funneling of the web to the nip zone 95 between drive roller 86 and pinch rollers 98, 99 and 100. In particular, the upper and lower guide plates 90 and 92 converge near the nip zone 95 between the drive roller and the pinch rollers in order that the web is directed into the nip zone.

Pinch rollers 98, 99 and 100 are independently rotatable about shafts 101, 102 and 103, respectively. Shafts 101, 102 and 103 are in turn supported by yolks 104, 105 and 106, respectively. Each of yolks 104, 105 and 106 pivot about shaft 107 which supports the roller assembly and is controlled by a spring mechanism. The roller assembly is attached to the frame 108 using shaft 107 using a pivoting spring mechanism or the like, and the amount of pressure between the drive roller and the pinch roller assembly is introduced by disengaging arm 109, or other such engaging/disengaging device (see FIG. 1). Thus, the feed of web through nip zone 95 is allowed. Preferably, the pinch rollers are manufactured from a resilient rubber, and the drive roller has a knurled surface or other such configuration in order that a certain amount of friction can be maintained between the pinch rollers and the drive roller. In such a manner, adequate feeding of the web 23 into nip zone or cutting zone 110 of the series of cutter knives can be assured. Plate 111 is positioned in a vertical manner between the bottom region of the drive roller in order to assure that the web passes into cutting zone 110.

Figure 6:
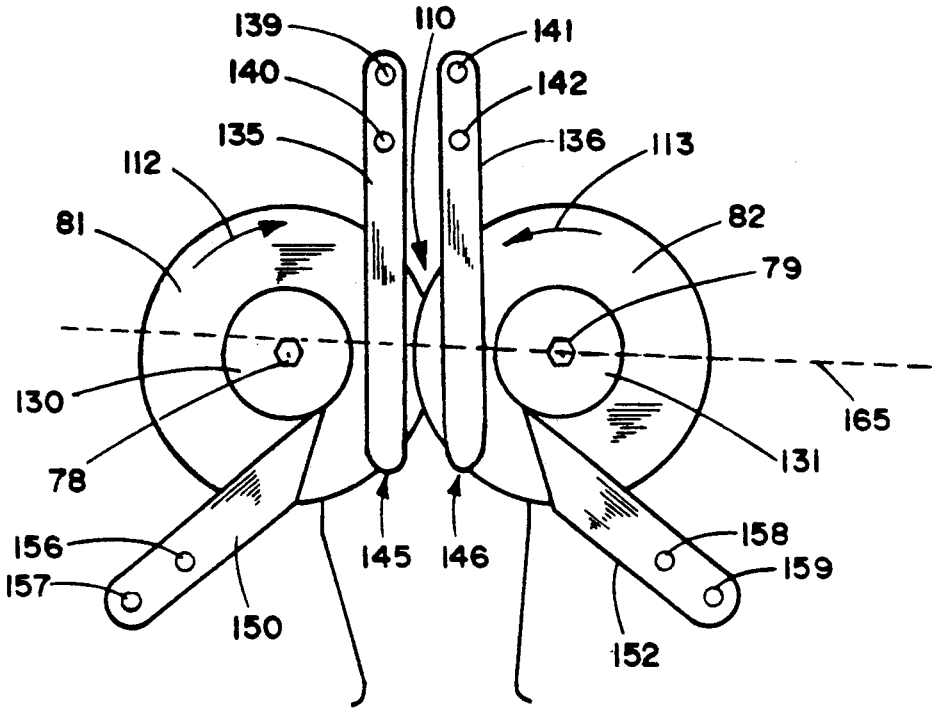
FIG. 6 is an enlarged sectional view of a portion of the slitting unit.
Figure 5:
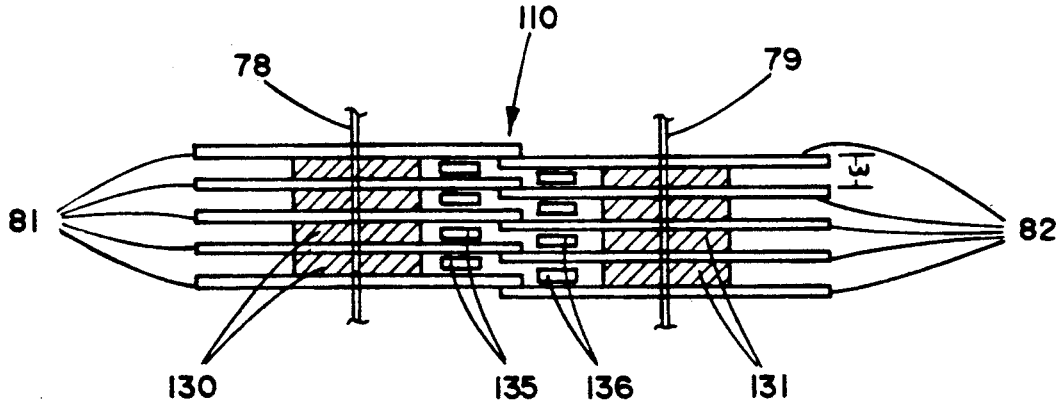
FIG. 5 is an enlarged partial sectional view of the slitting unit taken along lines 5—5 in FIG. 3.

Referring to FIGS. 3, 5 and 6, the two series of cutter knives 81 and 82 are rotated in opposite directions as shown by arrows 112 and 113, respectively. The two series of knives are each rotated in opposite directions by the rotation of the respective central shafts such that the web is passed through the slitting zone or nip zone 110 thereof. The central shafts can have a hexagonal cross sectional shape (as shown in FIGS. 4 and 6) or other shape which can provide for a good rotation of the cutter knives upon the rotation of the central shafts. The cutting assembly is maintained on the respective central shaft by nuts 118 and 119, or other securing means at each end of the central shafts. The central shafts 78 and 79 are supported or positioned within the frame or chassis 108 of the slitter unit 38 by respective bearing housings 125 and 126, or the like. The opposite ends of the respective shafts are also secured to the frame or chassis by respective bearing housings (not shown). Further, the opposite ends of the respective shafts are connected to respective Hookes joints or universals (not shown) or other such further means for providing for rotational movement as well as adjustment between the cutter assemblies. Each of the universals are connected to respective shafts (not shown), which are in turn connected to respective Hookes joints (not shown) which are in turn connected to the respective shafts (not shown) of the transmission unit. The various configurations of shafts, Hookes joints and transmission unit will be apparent to the skilled artisan.

The individual cutter knives are manufactured from chrome/vanadium steel, or the like, have a circular shape, and are assembled on the respective shafts to provide the slitting action and a spaced apart relationship by spacers 130 and 131. The assembled shafts are preloaded one relative to the other to provide the configuration generally shown in FIG. 5. Thus, the width of a strand formed by the slitter unit is very nearly equal to that distance w (shown in FIG. 5) which is the width of one cutter knife and the width of one spacer. The spacers have a circular shape, and the diameter thereof is less than that of the circular cutter knives. For example, as shown in FIGS. 5 and 6, the diameter of individual spacers 130 and 131 are about half of that of individual cutter knives 81 and 82. The spacers can be manufactured from polycarbonate, metal, or the like.

A series of guide combs 135 and 136 are positioned so as to extend between the adjacent cutter knives of each assembly. The thickness of the individual guide combs are less than that of the individual spacers. The guide combs 135 and 136 are held in place by support rods 139, 140 and 141, 142, a pair of which extend through the series of combs 135 and 136, respectively. The guide combs extend through the region between adjacent knives of an assembly in the region between the spacer and the region of overlap of cutter knife blades. The guide combs act to ensure that the web enters the nip of the cutter knives. The guide combs extend a small distance (e.g., about ⅛ inch for cutter knives having 4 inch diameter) beyond the outer face of the knife at regions 145 and 146 in order to ensure that the strands formed by the cutting action of the cutter knives cleanly exit the cutting region.

A series of cleaning combs 150 and 152 are positioned so as to extend between adjacent knives within each assembly. The cleaning combs are positioned near the bottom region of the cutter knives and provides for the removal of fines, dust and other impurities from the slitting or cutting process. The thickness of the individual cleaning combs 150 and 152 are generally less than that of the spacers. The cleaning combs 150 and 152 are held in place by support rods 156, 157 and 158, 159, a pair of which extend through the series of combs 150 and 152, respectively.

The guide combs and the cleaning combs can be manufactured from materials such as polycarbonate, metal, or the like.

Central shafts 78 and 79 are aligned essentially parallel to one another in the vertical plane. In such a manner, the overlap of the cutter knives of the respective series is essentially equal along length of the cutter or slitting unit. However, central shafts 78 and 79 are offset from one another in the horizontal plane. For example, shaft 78 and shaft 79 are positioned in the same horizontal plane (the horizontal plane is shown by dotted line 165 in FIG. 6) at the point at which each of the shafts are connected to the transmission unit; but shaft 78 is positioned at an angle so as to extend outward from the drive means in a direction below the horizontal plane. For example, for central shafts 78 and 79, each having lengths of about 14 inches, the outer end of shaft 78 is positioned about 0.03 inch lower than the outer end of shaft 79. The offset positioning whereby the outer end of central shaft 78 is lower in the horizontal plane than shaft 79 provides for contact of the overlapping cutter knives at a point near the upper portion of nip zone 108 (i.e., such that the blade contact is in a horizontal plane above that plane formed by shafts 78 and 79). Such contact is provided by a preloading of the cutter assemblies.

One cutter knife 81 provides contact force at the surface of one cooperating cutter knife 82 of the opposite cutter assembly such that there exists a force between the surfaces at which the cooperating blades contact. Such contact occurs at the extreme upper point at which blades 81 and 82 undergo overlap. The combined flexibility and resiliency of the individual blades provide a maintenance of the contact force between cooperating blades during operation of the slitting unit. The normal amount of overlap of the knives (as shown in FIG. 5) can range from about 1/32 inch to about ¼ inch for knives of 4 inch diameter.

Referring to FIG. 3, the web 23 is fed by the rotation of the drive roller and passes through the cutting unit provided by the cooperating series of cutter assemblies, and the resulting series of strands 167 exits into funnel 169. The series of strands exit the funnel 169 into an enclosed condensing funnel 172, which directs the strands into stuffer jet 175.

Figure 7:
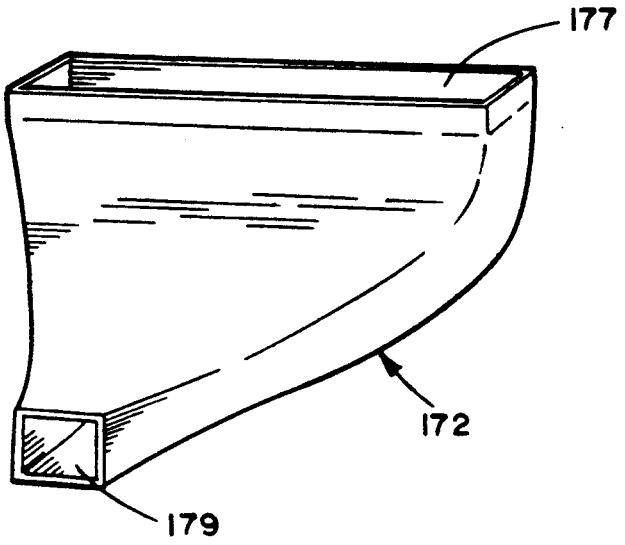
FIG. 7 is an enlarged perspective of the condensing funnel.

Referring to FIG. 7, condensing funnel 172 is manufactured from stainless steel sheet, aluminum sheet, or the like. The top portion 177 is open so that continuous strands of shredded web can be directed from the bottom funnel of the slitting apparatus into the condensing funnel 172. The strands entering the top portion 177 of the condensing funnel are directed into and through the condensing funnel and exit the opposite end 179 thereof. The opposite end 179 of the condensing funnel is preferably directed in an essentially horizontal direction.

Figure 8:
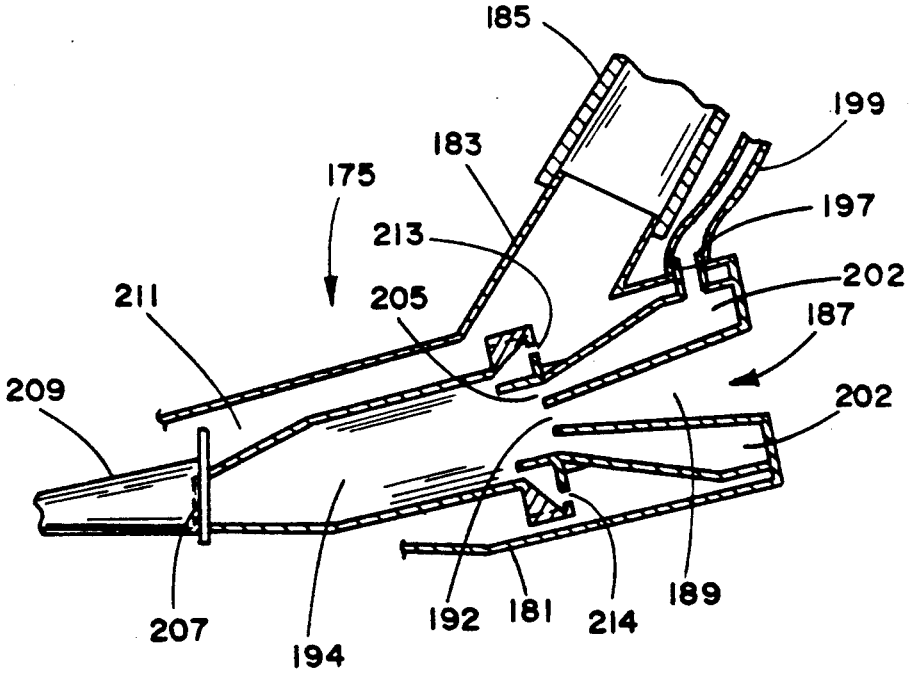
FIG. 8 is an enlarged longitudinal sectional view of the stuffer jet.

Referring to FIG. 8, stuffer jet 175 includes an outer container 181 with tube 183 or other outlet means connected to a hose 185 or other tube connected to a vacuum line (not shown) for removing dust, etc. from the location. The inner portion of the stuffer jet includes an inlet portion 187 where continuous strands are received from the outlet portion of the condensing funnel. The inlet portion has a cross section shape which corresponds to that of the outlet portion 179 of the condensing funnel (for example, square for the configuration shown in FIG. 7). The strands enter chamber 189, exit outlet end 192 of the chamber and enter second chamber 194. Air from a pressurized line or other source (not shown) enters air inlet port 197 by tube 199 into hollow region 202 which is positioned as a chamber between the chamber 189 and the outer container 181. The airflow from the inlet port 197 is directed toward the exit region 205 thereof near the open end 192 of the chamber 189. In this way the airflow drives the strands from first chamber 189 into second chamber 194 where it provides a crimping action to the strands. Air and strands exit the open end 207 of the chamber 194. The strands are fed into gathering means such as tongue 209 of the rod making unit 10. Typically, casing 210 which forms the outer wall of the chamber 194 has a circular cross sectional shape for easy cooperation with the tongue. Excess air passes into outer chamber 211, through passageways 213, 214 and is drawn through the outlet means 183 by vacuum or pump (now shown). Chamber 211 removes excess air and dust from the stuffer jet and the interface thereof with the tongue 209.

Referring again to FIG. 1, the tongue 209 or other such gathering means provides for the conversion or formation of the plurality of continuous strands into a cylindrical (i.e., rod-like) shape whereby the continuously extending strands are aligned essentially along the longitudinal axis of the cylinder so formed.

The series of continuous strands which is compressed into a cylindrical composite is fed into wrapping mechanism 220 which includes an endless garniture conveyer belt 222. The endless garniture conveyer belt is continuously and longitudinally advanced using advancing mechanism 224. The wrapping mechanism provides a strip of wrapping material 226 to the outer surface of the cylindrical composite to produce a continuous rod 228. Typically, the wrapping material 226 is provided from web 230.

The endless garniture conveyer belt transports the strip of wrap 226 and cylindrical composite of strands in a longitudinally extending manner through the wrapping mechanism 220 while draping or enveloping the wrapping material about the cylindrical composite. The seam formed by an overlapping marginal portion of the wrapping material has adhesive (e.g., holt melt adhesive) applied thereto by applicator 232. The hot melt adhesive is reactivated in reactivating region 233 in order that the wrapping material can form a tubular container for the plurality of strands. The adhesive can be cooled using chill bar 235 in order to cause rapid setting of the adhesive. Other means for securing or sealing the wrapping material can be employed in providing the continuous rod.

The continuous rod passes from the sealing means and is subdivided (e.g., severed) at regular intervals at the desired, predetermined length using cutting means 238. The succession or plurality of rods 240 are collected for use in collection means 242 such as a tray, collection drum or the like.

As used herein, by the term "sheet-like" is meant that the material is in a configuration or form wherein the width and length thereof are substantially greater than the thickness thereof. By the term "strip" or "web" is meant that the material in sheet-like form is in a configuration or form wherein the longitudinally extending length thereof is substantially greater than the width thereof. Preferably, a strip or web of sheet-like material is provided in roll form. By the term "strand" is meant that the material is in a configuration or form wherein the longitudinally extending length thereof is substantially greater than both the width and thickness thereof, and the width thereof is substantially less than that of the strip from which the strand is formed.

The appearance, composition and properties of the sheet-like material can vary. The color of the sheet-like material can be any color or range of colors desired. Generally, the dry tensile strength of the sheet-like material is greater than about 3 pounds per 27 mm, preferably greater than about 4 pounds per 27 mm as determined using a Thwing Albert Model No. QC II Tensile Tester. Most preferably, the sheet-like material is a nonwoven, fibrous, reconstituted tobacco material such as is produced using a papermaking-type process. For example, the fibrous sheet-like material is a felted or matted sheet of fibers. Most desirably, the fibers are provided from tobacco materials or mixtures of tobacco materials with natural materials such as wood, grains, flax, and the like, as well as combinations thereof.

It is particularly desirable to employ a tobacco-containing sheet-like material such as reconstituted tobacco. Of particular interest are reconstituted tobacco materials containing greater than about 50 percent, preferably greater than about 65 percent by weight of tobacco; and less than about 50 percent, preferably less than about 35 percent by weight of cellulose (i.e., wood) pulp. If desired, such reconstituted tobacco materials can contain binders and/or fillers such as clays, calcium carbonate, or the like. It is particularly desirable to employ a reconstituted tobacco material having greater than about 20 percent by weight of tobacco character extractables determined according to U.S. Alcohol, Tobacco and Firearms (ATF) Procedure 73-5. Typically, basis weight of suitable reconstituted tobacco materials range from about 30 to about 100, preferably about 40 to about 65 grams per square meter of sheet, as determined using TAPPI Standard T 410. In order to prevent shrinkage of rods of this invention, it is desirable to employ strips of reconstituted tobacco materials having a moisture content of less than about 15 percent, preferably from about 7 to about 14 percent, more preferably from about 9 to about 13 percent. By the term "moisture content" is meant the percent weight loss of the filler material after heating the material at 220° F. for 5 minutes.

The thickness of the sheet-like material can vary, and typically is dependent upon the composition and strength of the material, the desired properties of strand which ultimately is provided, and other such factors. Generally, the thickness of a particular strip of sheet-like material is sufficient to provide a suitable strength during the processing stages thereof, and ultimately to provide a rod capable of exhibiting the desired properties. Most frequently, the thickness of a strand is less than that of the width thereof. Generally, the thickness of the sheet-like material ranges from about 0.001 inch to about 0.01 inch, more preferably from about 0.003 inch to about 0.006 inch.

The width of the strand can vary, and is typically dependent upon the manner in which the sheet-like material is shredded to form the strand, the desired properties of the strand, and other such factors. For example, it is desirable to provide strands having widths which are not so narrow as to exhibit poor strengths, have a tendency to break, or have a tendency to become entangled to an undesirable degree upon formation in the shredding apparatus. Conversely, for example, it is desirable to provide strands which are not so wide in order that, when employed for the manufacture of a filter element, such strands can provide a filter element having desirable pressure drop (i.e., resistance to draw) values, an acceptable appearance, and an acceptable filtration efficiency. Typically, strips of sheet-like material of relatively great thickness can be shredded to a relatively narrow width. Generally, the width of a typical strand is that width which is obtained by shredding the sheet-like material at from about 25 cuts per inch to about 60 cuts per inch, preferably from about 30 cuts per inch to about 45 cuts per inch. Such strands have widths ranging from about 1/25 inch to about 1/60 inch, preferably from about 1/30 inch to about 1/45 inch.

The width of the strip of sheet-like material can vary, and typically is a width capable of being shredded to form at least a portion of the strands which are further employed in providing the rod. The total width of the strip employed in providing strands for the formation of a desired rod can depend upon factors such as the thickness of the sheet-like material, the number of strands desired, the nature or character of the strands produced (i.e., straightened or elongated versus crimped or wavy), the surface character of the material (i.e., a fibrous surface character versus a smooth surface), the porosity of the material, and other such factors. For example, a rod having 320 strands each 1/32 inch in width and produced from sheet-like material can be provided either from a roll of sheet-like material having a width of 10 inches or from 2 rolls of sheet-like material each having a width of 5 inches. For most applications of this invention, sheet-like material providing a total width of from about 7 inches to about 15 inches, preferably from about 8 inches to about 12 inches, can be employed. Furthermore, for most applications of this invention, typical rods have circumferences which range from about 17 mm to about 28 mm, frequently from about 20 mm to about 26 mm, and contain more than about 175 generally longitudinally extending strands.

As used herein, the term "sizing agent" refers to an agent employed to surface-treat the sheet-like material in order to reduce the propensity of particular materials to be absorbed or adsorbed by the sheet-like material. Thus, the term "hydrophobic sizing agent" refers to a hydrophobic agent which is used to surface treat the sheet-like material in order to reduce the propensity of moisture to be absorbed or adsorbed by the sheet-like material (i.e., in order to provide a water repellency characteristic to the material).

Preferred sizing agents are chemically reactive sizing agents. Such sizing agents are employed in papermaking-type processes (e.g., when making reconstituted tobacco materials) or are added externally to the sheet-like material in a surface sizing operation. Typically, chemical sizing agents are employed in the papermaking operation at addition levels of about 0.05 to about 5 percent, more typically about 0.1 to 3 percent, based on the ultimate dry weight of the sheet-like product. Examples of suitable sizing agents include the fatty acid anhydrides and the alkyl ketene dimers.

Figure 9:
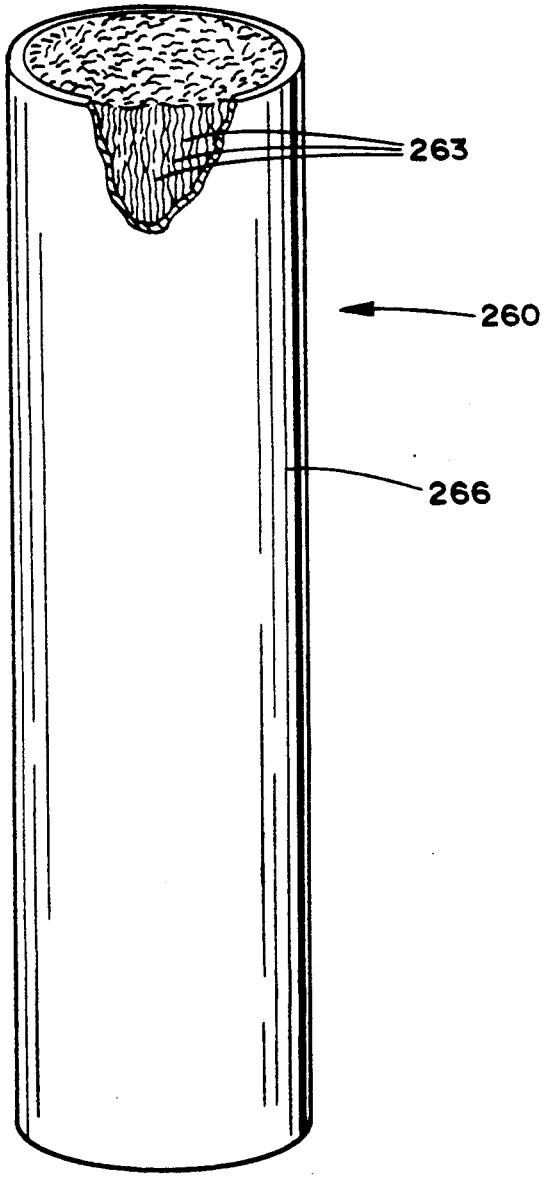
FIG. 9 is a perspective of a rod of this invention showing the plurality of substantially longitudinally extending strands provided from sheet-like material, and the circumscribing wrap shown as partially cut away.

Referring to FIG. 9, rod 260 has a substantially cylindrical shape. Preferably, the ends of the rod each form a plane perpendicular to the longitudinal axis thereof. The rod includes a plurality of longitudinally extending strands 263 which are provided from sheet-like material. The strands 263 extend generally along the longitude of the rod. The strands are contained in a wrapping material 266 such as cigarette paper wrap or paper plug wrap which is formed in a tubular shape around the strands.

The collected rods are suitably employed in the manufacture of cigarette filter elements. For example, the rods can be cut to the desired size resulting in cylindrical filter elements for the manufacture of filter cigarettes. Typical rod sizes for use in the manufacture of filter elements range in length from about 80 mm to about 130 mm, and from about 17 mm to about 27 mm in circumference. For example, a typical rod having a 100 mm length and 24.53 mm circumference exhibits a pressure drop of from about 200 mm to about 400 mm of water as determined at an airflow rate of 17.5 cc/sec using an encapsulated pressure drop tester, sold commercially as Model No. FTS-300 by Filtrona Corporation. One method for controlling the pressure drop of such a rod involves producing strands having a crimped character and positioning the individual strands in a longitudinally extending manner such that air can flow longitudinally through the rod in the spaces between the strands.

Figure 10:
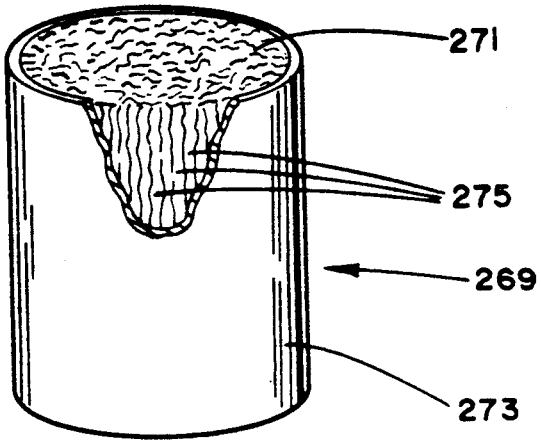
FIG. 10 is a perspective of a cigarette filter element provided from a rod showing the plurality of substantially longitudinally extending strands provided from sheet-like material, and the circumscribing wrap shown as partially cut away.

Referring to FIG. 10, filter element 269 has a substantially cylindrical shape. Preferably, the ends of the plug each form a plane perpendicular to the longitudinal axis thereof. The filter element includes filter medium 271 which is overwrapped (i.e., enveloped) along the longitudinally extending surface with circumscribing wrap material 273. The filter medium includes a plurality of generally longitudinally extending strands 275 provided from sheet-like material. The filter element has a longitudinally extending length and circumference comparable to the length and circumference of a filter element employed in the manufacture of a conventional cigarette.

Typical filter elements of this invention exhibit good firmness and good integrity. In particular, it is desirable that the various strands not readily fall out of the ends of the filter element. The filter elements exhibit a firmness value of less than 10 units characteristic of a cylindrical rod shaped element having a circumscribing paper wrap, a length of about 100 mm and circumference of about 24.5 mm as measured at 76° F. and 60 percent relative humidity using a Cigarette Firmness Tester Model No. CFTA supplied by Fairchild Industries, Winston-Salem, N.C. As used herein, the term "units" in referring to the firmness value represents each 0.1 mm of vertically measured depression exhibited by the filter element when subjected to a force in the form of a load supplied transversely to the longitudinal axis thereof (i.e., the direction of the force supplied by the load is perpendicular to the longitudinal axis of the filter element). The depression exhibited by the filter element is determined by subjecting a 1 inch diameter, flattened stainless steel testing pad equipped with a load (total weight thereof is about 20 g) which rests on the filter element to the force provided by a 205 g load which is placed on the testing pad for a period of 5 seconds. A low measured firmness value represents a high firmness of the sample. Preferably, the firmness value of the filter elements is less than about 5, more preferably between about 3 and about 5, for elements evaluated as described hereinbefore.

Figure 11:
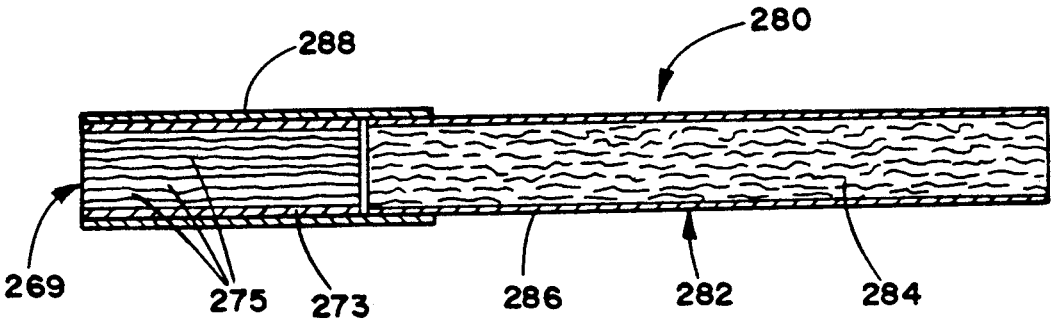
FIG. 11 is a diagrammatic cross sectional longitudinal view of a cigarette showing the rod of smokable material, and the axially aligned filter element having strands which extend generally along the longitude thereof.

An embodiment of this invention shown in FIG. 11 is a smoking article in the form of a cigarette 280. The cigarette includes a generally cylindrical rod 282 of smokable material 284 contained in a wrapping material 286. Typically, the smokable material is a charge of cured or processed tobacco, reconstituted tobacco, tobacco substitute, or blend thereof. The smokable material generally is material conventionally employed in the manufacture of cigarettes (i.e., as shreds or strands of material about 1/32 inch wide and treated with conventional additives such as humectants and flavorants). Typically, the wrapping material is a conventional cigarette wrapping paper. The ends of the rod are open to expose the smokable material. Rod 286 has a circumference comparable to that of conventional cigarettes and has a longitudinally extending length comparable to the tobacco rod length of conventional cigarettes. The smoking article further includes previously described filter element 269 positioned adjacent to one end of rod 286 such that the filter element is axially aligned with the rod in an end-to-end relation. Filter element 269 has a substantially cylindrical shape, a plurality of longitudinally extending strands 275, a circumscribing wrap 273, and the diameter of the rod is substantially equal to the diameter of the filter element. Preferably, the filter element substantially abuts the rod. The ends of the filter element are open to permit the passage of air and smoke. Preferably, the filter element has a longitudinally extending length which ranges from about 19 mm to about 31 mm. Filter element 269 is attached to rod 282 by tipping material 288 which circumscribes both the filter element and an adjacent region of the rod. The inner surface of the tipping material is fixedly secured (e.g., using an adhesive) to the outer surface of the filter element and to the wrapping material of an adjacent region of the rod. The tipping material circumscribes the rod over a longitudinal length which can vary but is typically that length sufficient to provide good attachment of the filter element to the rod. The tipping material can be either a conventional air permeable tipping material or a conventional substantially air impermeable tipping material. Typically, the tipping material is tipping paper. If desired, openings such as slits, holes, or perforations in the substantially air impermeable tipping material and the plug wrap can provide a means for air dilution of the smoking article.

Figure 12:
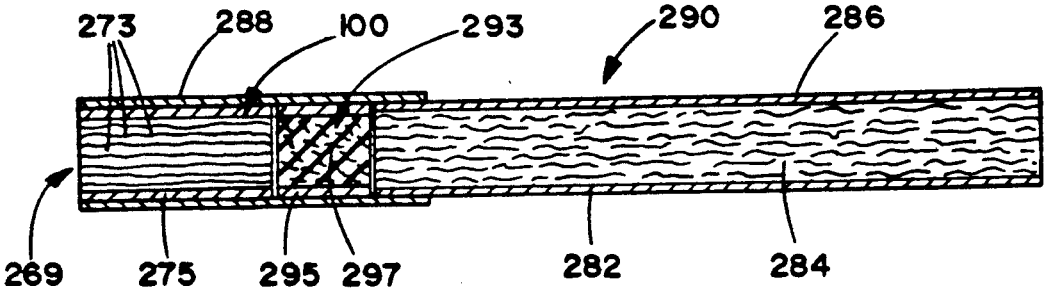
FIG. 12 is a diagrammatic cross sectional longitudinal view of a cigarette showing aligned in sequence the rod of smokable material, a first filter element, and a second filter element having strands which extend generally along the longitude thereof.

An embodiment of this invention shown in FIG. 12 is a smoking article in the form of a cigarette 290 having a generally cylindrical rod 282 of smokable material 284 contained in wrapping material 286. The smoking article further includes filter element 293 axially aligned with the rod 282 in an end-to-end relation. This filter element 293 has a substantially cylindrical shape, has a diameter which is substantially equal to that of the rod, and preferably substantially abuts the rod. Second filter element 269 is axially aligned with filter element 293 in an end-to-end relation, has a substantially cylindrical shape, has a diameter in combination with the optional wrap material which is substantially equal to that of the rod, and preferably substantially abuts the filter element 293. Filter element 293 can be conventional tow material 297 such as cellulose acetate, or the like. Filter element 293 can have a generally fibrous character, a molded shape, or other such configuration. Optionally, the filter element 293 is overwrapped with a circumscribing wrap material 295 such as a conventional filter plug wrap, or the like. Previously described filter element 269 is axially aligned with filter element 293. The longitudinal length of filter element 293 relative to the longitudinal length of filter element 269 can vary depending upon the application desired. The filter region (i.e., axially aligned filter element 293 and filter element 269) is attached to rod 282 by tipping material 288 which circumscribes both the filter elements and an adjacent region of the rod.

It is understood that the particular embodiments described herein are only illustrative of the principles of this invention, and that various modifications can be made by those skilled in the art without departing from the scope and spirit of this invention. For example, ovoidal shaped filter elements and cigarettes can be manufactured.

The following example is provided in order to further illustrate the invention but should not be construed as limiting the scope thereof. Unless otherwise noted, all parts and percentages are by weight.

EXAMPLE 1

A web of reconstituted tobacco material having a width of about 11 inches is obtained from Kimberly Clark Corp. as MX3-A Reconstituted Tobacco Sheet. The material contains about 65 percent tobacco principally in the form of flue-cured tobacco stems and 35 percent soft wood pulp (based on dry weight of the material). The moisture content of the sheet-like material preferably is about 11 percent. The material has a golden brown color provided by less than 0.50 percent yellow dyes and less than 1.5 percent humic acid, which are added during the manufacturing process thereof. The material has a dry tensile strength of about 2,500 to about 3,000 gm/inch, and a dry basis weight of about 58 to about 62 g/sq. meter. The material is manufactured using a papermaking-type process including the addition of about 2 percent triethylene glycol humectant and about 1 percent of a commercial sizing agent. The sizing agent is commercially available as Aquapel 360XC Reactive Size from Hercules Corp., Wilmington, Del.

A roll of the reconstituted tobacco material is processed using the apparatus generally described in FIGS. 1–8 in order to provide filter rods having lengths of 108 mm and circumferences of 24.53 mm. The filter rods have a circumscribing essentially air impermeable paper plug wrap. Each rod includes about 350 strands each having a width of about 1/32 inch and thickness of 0.006 inch. The strands have a certain amount of crimp such that the average length of strand in a 108 mm rod is about 115 mm. The pressure drop of a rod is about 300 mm of $H_2O$ when measured using the technique described hereinbefore.

The slitter unit includes two slitter assemblies, each having 200 cutter knives of 0.012 inch thickness and 4 inch diameter. The knives on each assembly are separated by polycarbonate spacers of 2 inch diameter and 0.02 inch thickness. The combined thickness of one knife and one spacer is about 0.032 inch which is approximately that of the strands formed using the slitter unit. Guide combs made from polycarbonate have a length of 5 inches, a width of ⅝ inch, a thickness of 0.015 inch; and extend about ⅛ inch beyond the bottom face of the cutter assembly. Finished rods each of 108 mm length are provided at a rate of about 1500 to about 2000 rods per minute.

The rods so provided are useful for providing filter elements of 27 mm length for cigarettes.

Alternatively, rods are manufactured as described hereinbefore and provided in 90 mm lengths. The rod is cut into 6 lengths of 15 mm each and combined with filter plugs including cellulose tow circumscribed by paper plug wrap. The cigarette having the configuration shown in FIG. 12 is manufactured and has a tobacco rod of 59 mm length, and the filter element of 25 mm length.

What is claimed is:

1. A rod for the preparation of cigarette filter elements, the rod comprising a plurality of strands provided from tobacco-containing, nonwoven sheet-like material, wherein (i) the strands extend generally along the longitude of the rod, each have a width greater than the thickness thereof, and are contained in a circumscribing wrap; and (ii) the sheet-like material includes a sizing agent having a hydrophobic character.

2. The rod of claim 1 wherein the strands each have a thickness of about 0.001 inch to 0.01 inch and a width of about 1/25 inch to about 1/60 inch.

3. The rod of claim 1 wherein the rod has a circumference of about 16 mm to about 28 mm and the number of strands is greater than 175.

4. The rod of claim 1 wherein the tobacco-containing material has a moisture content of less than about 15 weight percent.

5. The rod of claim 1 having about 320 independent strands.

6. A rod for the preparation of cigarette filter elements, the rod comprising a plurality of strands provided from tobacco-containing, nonwoven sheet-like material, wherein (i) the strands extend generally along the longitude of the rod, each have a width greater than the thickness thereof, and are contained in a circumscribing wrap; and (ii) the sheet-like material includes a sizing agent having a hydrophobic character, the sizing agent being an alkylketene dimer.

7. The rod of claim 6 wherein the tobacco-containing sheet-like material is manufactured using a papermaking-type process.

8. The rod of claim 7 wherein the tobacco-containing sheet-like material contains from about 50 percent to about 100 percent tobacco material and about 0 percent to about 50 percent cellulosic material, based on the total weight of the sheet-like material.

9. The rod of claim 7 wherein the reconstituted tobacco material contains greater than about 65 percent by weight of tobacco.

10. The rod of claim 7 wherein the sizing agent is incorporated into the sheet during the manufacture thereof at an amount of about 0.05 to about 5 percent, based on the ultimate dry weight of the sheet-like material.

11. An essentially cylindrical filter element for a smoking article, the filter element comprising a plurality of strands provided from tobacco-containing, nonwoven sheet-like material, wherein (i) the strands extend generally along the longitude of the element, each have a width greater than the thickness thereof, and are contained in a circumscribing wrap; and (ii) the sheet-like material includes a sizing agent having a hydrophobic character.

12. The filter element of claim 11 wherein the strands each have a thickness of about 0.001 inch to 0.01 inch and a width of about 1/25 inch to about 1/60 inch.

13. The filter element of claim 11 wherein the element has a circumference of about 16 mm to about 28 mm and the number of strands is greater than 175.

14. The filter element of claim 11 wherein the tobacco-containing material has a moisture content of less than about 15 weight percent.

15. The filter element of claim 11 having about 320 independent strands.

16. The rod of claim 1 wherein the strands each have a width of about 1/32 inch.

17. The filter element of claim 11 wherein the strands each have a width of about 1/32 inch.

18. The filter element for a smoking article, the filter element comprising a plurality of strands provided from tobacco-containing, nonwoven sheet-like material, wherein (i) the strands extend generally along the longitude of the element, each have a width greater than the thickness thereof, and are contained in a circumscribing wrap; and (ii) the sheet-like material includes a sizing agent having a hydrophobic character, the sizing agent being an alkylketene dimer.

19. The filter element of claim 18 wherein the tobacco-containing sheet-like material is a material which is manufactured using a papermaking-type process.

20. The filter element of claim 19 wherein the tobacco-containing sheet-like material contains from about 50 percent to about 100 percent tobacco material and about 0 percent to about 50 percent cellulosic material, based on the total weight of the sheet-like material.

21. The filter element of claim 19 wherein the reconstituted tobacco material contains greater than about 65 percent by weight of tobacco.

22. The filter element of claim 19 wherein the sizing agent is incorporated into the sheet during the manufacture thereof at an amount of about 0.05 to about 5 percent, based on the ultimate dry weight of the sheet-like material.

23. A cigarette comprising a rod of smokable material aligned with and having attached to one end thereof a filter element, the filter element having a plurality of strands provided from tobacco-containing, nonwoven sheet-like material, wherein (i) the strands extend generally along the longitude of the rod, each have a width greater than the thickness thereof, and are contained in a circumscribing wrap; and (ii) the sheet-like material includes a sizing agent having a hydrophobic character.

24. A cigarette comprising a rod of smokable material aligned with and having attached at one end thereof, two filter elements in sequence, one of which filter elements has a plurality of strands provided from tobacco-containing, nonwoven sheet-like material, wherein (i) the strands extend generally along the longitude of the rod, each have a width greater than the thickness thereof, and are contained in a circumscribing wrap; and (ii) the sheet-like material includes a sizing agent having a hydrophobic character.

25. The rod of claim 6 wherein the strands each have a thickness of about 0.001 inch to 0.01 inch and a width of about 1/25 inch to about 1/60 inch.

26. The rod of claim 6 wherein the rod has a circumference of about 16 mm to about 28 mm and the number of strands is greater than 175.

27. The rod of claim 6 wherein the tobacco-containing material has a moisture content of less than about 15 weight percent.

28. The rod of claims 6 or 7 having about 320 independent strands.

29. The filter element of claim 18 wherein the strands each have a thickness of about 0.001 inch to 0.01 inch and a width of about 1/25 inch to about 1/60 inch.

30. The filter element of claim 18 wherein the element has a circumference of about 16 mm to about 28 mm and the number of strands is greater than 175.

31. The filter element of claim 18 wherein the tobacco-containing material has a moisture content of less than about 15 weight percent.

32. The filter element of claims 18 or 19 having about 320 independent strands.

33. The rod of claim 6 wherein the strands each have a width of about 1/32 inch.

34. The filter element of claim 18 wherein the strands each have a width of about 1/32 inch.

* * * * *